US009786260B2

(12) United States Patent
Fishman

(10) Patent No.: US 9,786,260 B2
(45) **Date of Patent: *Oct. 10, 2017**

(54) METHOD AND DEVICE FOR RECHARGEABLE, RETROFITTABLE POWER SOURCE

(71) Applicant: Fishman Transducers, Inc., Wilmington, MA (US)

(72) Inventor: Lawrence Fishman, Winchester, MA (US)

(73) Assignee: Fishman Transducers, Inc., Wilmington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/142,121

(22) Filed: Apr. 29, 2016

(65) Prior Publication Data

US 2016/0247498 A1 Aug. 25, 2016

Related U.S. Application Data

(63) Continuation of application No. 14/594,885, filed on Jan. 12, 2015, now Pat. No. 9,384,722.

(60) Provisional application No. 61/925,933, filed on Jan. 10, 2014.

(51) Int. Cl.

| | |
|---|---|
| ***G10H 1/32*** | (2006.01) |
| ***G10H 3/18*** | (2006.01) |
| ***G10H 1/18*** | (2006.01) |
| ***G10D 1/08*** | (2006.01) |

(52) U.S. Cl.

CPC ..... *G10H 3/186* (2013.01); *G10D 1/085* (2013.01); *G10H 1/18* (2013.01); *G10H 1/32* (2013.01); *G10H 3/18* (2013.01)

(58) Field of Classification Search

CPC ..... G10H 1/32
USPC ..... 84/743
See application file for complete search history.

(56) References Cited

U.S. PATENT DOCUMENTS 3,781,451 A * 12/1973 Nolan ..... G10H 1/0083 84/267
3,943,815 A * 3/1976 Gilbert ..... G10D 1/08 362/559
4,186,641 A * 2/1980 Dorfman ..... G10H 1/0083 84/723
4,245,540 A * 1/1981 Groupp ..... G10H 3/26 84/726
4,312,258 A * 1/1982 Park ..... G10D 1/085 181/150
4,351,217 A * 9/1982 Wechter ..... G10D 3/00 84/267
4,711,149 A * 12/1987 Starr ..... G10H 3/182 84/477 R
4,807,509 A * 2/1989 Graham ..... G10D 3/06 84/314 R
5,007,324 A * 4/1991 DeMichele ..... G10H 1/0058 84/477 R
5,391,833 A * 2/1995 Clement ..... G10H 3/18 84/742

(Continued)

*Primary Examiner* — David Warren
(74) *Attorney, Agent, or Firm* — Pearl Cohen Zedek Latzer Baratz LLP

(57) ABSTRACT

A power system on an electric guitar may include a cover plate covering a standard cavity in the electric guitar. A rechargeable power source may be contained within the standard cavity and may not extend beyond an external surface of the cover plate. Other instruments or configurations may be used.

19 Claims, 8 Drawing Sheets

(56) References Cited

U.S. PATENT DOCUMENTS

H001503 H * 12/1995 Threadgill ..... G10D 1/085 84/327
5,637,820 A * 6/1997 Wittman ..... G10D 1/085 84/327
5,693,898 A * 12/1997 Fishman ..... G10D 1/085 84/267
5,731,535 A * 3/1998 Hudak ..... G10H 1/0551 84/733
5,796,025 A * 8/1998 Haake ..... G10H 3/18 84/464 A
5,837,912 A * 11/1998 Eagen ..... G10D 3/00 84/267
5,877,444 A * 3/1999 Hine ..... G10G 7/02 84/454
5,936,179 A * 8/1999 Merrick ..... G10G 7/02 84/454
6,075,194 A * 6/2000 Marinic ..... G10H 1/10 84/600
6,787,690 B1 * 9/2004 Celi ..... G10H 1/125 84/600
7,593,782 B2 * 9/2009 Jobs ..... G06F 1/1616 700/94
8,455,750 B1 * 6/2013 Severson ..... G10H 3/183 84/743
8,502,061 B1 * 8/2013 Alt ..... G10H 3/186 84/725
9,000,287 B1 * 4/2015 Andersen ..... G10H 1/32 84/622
2004/0074380 A1 * 4/2004 Fishman ..... G10H 3/186 84/741
2004/0187673 A1 * 9/2004 Stevenson ..... G10H 1/02 84/737
2005/0098021 A1 * 5/2005 Hofmeister ..... G10H 1/0556 84/453
2005/0183566 A1 * 8/2005 Nash ..... G10H 1/32 84/601
2006/0032365 A1 * 2/2006 Brubaker ..... G10H 1/32 84/743
2007/0180975 A1 * 8/2007 Paris ..... G10D 3/02 84/291
2008/0184864 A1 * 8/2008 Holt ..... G10H 3/186 84/267
2008/0212319 A1 * 9/2008 Klipstein ..... B60Q 3/065 362/231
2009/0218985 A1 * 9/2009 Hallett ..... G10H 1/32 320/108
2009/0289635 A1 * 11/2009 Coccio ..... G01R 31/3634 324/427
2010/0087254 A1 * 4/2010 Sullivan ..... G10H 1/342 463/37
2011/0053131 A1 * 3/2011 Regnier ..... G10H 1/0016 434/250
2011/0113210 A1 * 5/2011 Klapman ..... G06F 17/30091 711/163
2013/0298751 A1 * 11/2013 Juszkiewicz ..... G10H 3/18 84/743
2013/0333546 A1 * 12/2013 Kondo ..... G10H 3/143 84/731
2014/0143933 A1 * 5/2014 Low ..... G04C 10/00 2/170
2014/0216235 A1 * 8/2014 Alt ..... G10H 3/186 84/726
2014/0361101 A1 * 12/2014 Maher ..... F24F 6/14 239/302
2015/0042287 A1 * 2/2015 Liu ..... B60L 11/182 320/134
2015/0047493 A1 * 2/2015 Leadbetter ..... G10H 1/44 84/454
2015/0199948 A1 * 7/2015 Fishman ..... G10H 1/32 84/726
2015/0234482 A1 * 8/2015 Jobs ..... G06F 3/0362 345/184
2016/0163299 A1 * 6/2016 Hummel ..... G10H 1/342 84/659

* cited by examiner

METHOD AND DEVICE FOR RECHARGEABLE, RETROFITTABLE POWER SOURCE

PRIOR APPLICATION DATA

This application is a continuation of U.S. patent application Ser. No. 14/594,885 filed on Jan. 12, 2015 and entitled "METHOD AND DEVICE FOR RECHARGEABLE, RETROFITTABLE BATTERY PACK" which in turn claims benefit of prior U.S. Provisional Application Ser. No. 61/925,933, filed Jan. 10, 2014, each of which being incorporated by reference herein in its entirety.

FIELD OF THE PRESENT INVENTION

The present invention relates to rechargeable power packs for electrical instruments, e.g., musical instruments.

BACKGROUND

Electrical stringed musical instruments such as guitars may require electrical current to power circuits that can pick up or detect vibrations from the instruments' strings and convert the vibrations to electrical signals to be amplified over a speaker, or for other purposes. During performance, a musician playing an electrical stringed instrument may be tethered (e.g., the instrument may be tethered) to an electrical cord that powers the instrument and may thus be limited in movement on the stage. Some electrical guitars may instead include batteries which may drain quickly and may be unable to maintain power levels or which may be bulky additions to the instrument without improving a musician's freedom on the stage.

SUMMARY

A power system on an electric guitar may include a back plate covering a standard control cavity in the electric guitar. The power system may further include a rechargeable battery contained within the standard control cavity and not extending beyond an external surface of the guitars back plate. Other instruments and configurations may be used.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
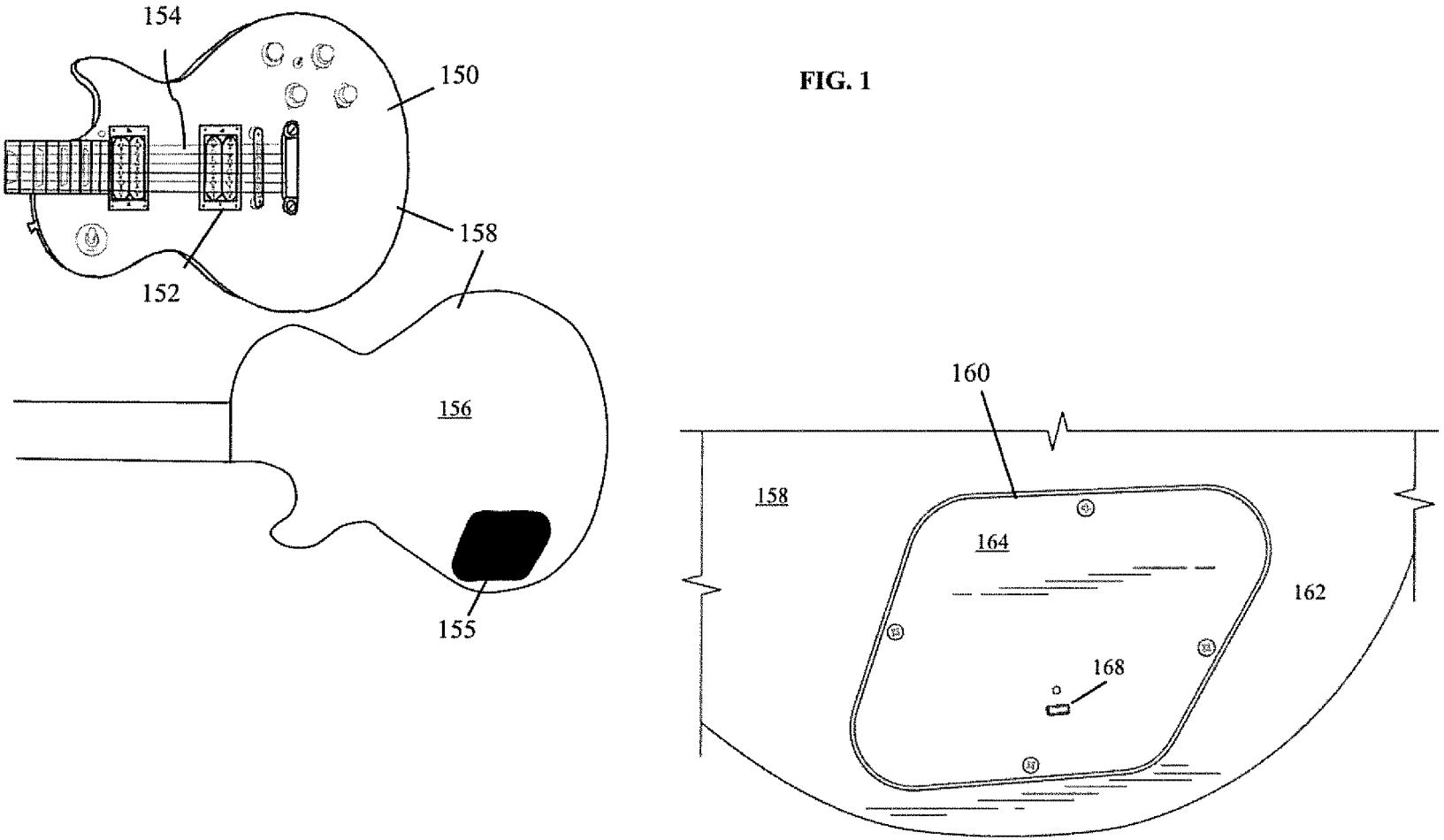
FIG. 1 is an illustration of a back plate for an electric guitar according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention.

Embodiments of the invention may provide for a power supply such as a rechargeable power supply for an electrical instrument, such as an electric guitar. The rechargeable power supply may be a rechargeable battery pack or power pack that fits within an existing or "standard" recess or cavity (which typically extends within the guitar), or within the electronic controls of, a typical electric guitar and which does not add to the volume, or to the external volume or shape, of the electric guitar, allowing a performer to freely move about the stage, and not interfering with the playability of the guitar. A "standard" cavity may be one that is, for example, included within the design of a model or brand of an electric instrument. The standard cavity may be, for example, a standard control cavity of an electric guitar, or a standard spring cavity found on some electric guitar models. The rechargeable battery or power pack may be retrofitted onto older guitars that are not battery powered, or which were not manufactured to be battery powered or to hold batteries. The rechargeable power system may include other components such as for example an amplifier or boost converter so that voltage from the battery is maintained at a high level to create desired high-powered sounds. The rechargeable power pack may be an integrated assembly (e.g., provided as one part, instead of multiple parts) in order to be fittable or completely assimilated within standard cavities or retrofittable into older guitar models, for example.

The Fender Stratocaster® guitar, for example, may have a standard screw-on back plate or cover plate that covers the springs for a whammy bar. A back plate may be a cover covering a standard cavity or recess, and may be on for example the back side (not the string side) of the guitar. In alternate embodiments other recesses or cavities, such as those not on the back side, may be used, and thus other covers or plates may be used; in addition other instruments may be used. A rechargeable power source or battery system holding a battery and other components may have the same size and shape as the standard cover (e.g., the cover meant by the designer for this particular instrument, guitar or model), with screw holes (or other attachment points or holes) in the battery cover to align with screw holes (or other attachment points or holes) on the guitar. When installed, the battery portion of the battery system extends from the cover within a pre-existing shell or cavity, and does not extend significantly outside beyond the shape of the guitar, or at all beyond the shape of the guitar. The battery may not extend significantly outside the cavity, or at all outside the cavity. The battery or battery pack may, for example, extend a quarter or half inch from the guitar's body, through some extension in the back plate. The rechargeable battery may include for example a standard USB or micro USB jack to connect a charger. Other ways to connect a charger may be used. To install the battery, the user may unscrew the standard plate, connect wiling to power guitar components such as the Fishman Fluence™ pickups or other active pickups, and screw or otherwise attached the rechargeable battery in place of the original cover.

In another example, the Gibson Les Paul® guitar may have a standard screw-on back plate that covers the volume and tone controls, which are within a shell or cavity. A rechargeable battery the same size and shape as this standard cover may be used, with screw holes in the battery cover to align with screw holes on the guitar, the battery itself (and associated components if any) fitting within the shell or cavity.

Other rechargeable power sources according to embodiments of the invention may fit other standard cover plates and cavities for other kinds of electric guitars, or other types of musical instruments. Rechargeable power sources may include rechargeable batteries (e.g., lithium ion or nickel cadmium batteries) or rechargeable super capacitors.

According to embodiments of the invention, a battery or battery pack or rechargeable battery pack may be retrofittable if it can be attached to or contained within an electric guitar without significant change or modification to the guitar's body structure. In some embodiments the battery pack may fit entirely or substantially entirely within the existing external boundaries or housing of the electric guitar. In some embodiments the battery or battery pack may fit entirely or substantially entirely within a cavity enclosure or recess created at the time of guitar manufacture, rather than within a recess, cavity, or enclosure created after manufacture for the purpose of holding a battery. Cutting a recess, cavity, or enclosure within musical instrument such as an electrical musical instrument after manufacture may affect the aesthetics and sound production of the instrument, or may carry a risk of damaging the instrument. Some guitars may include a standard back plate which covers a control cavity is removable by screws and which ordinarily houses the guitar's electronics, such as its active pickups and filter controls, for example A retrofittable battery pack may be able to replace the standard cover plate and be attached to the guitar by having the same screw alignment as the standard cover plate. In other embodiments, an electric guitar may include a standard cover plate which is removable by screws and which covers a standard spring cavity. The standard cover plate may also be replaced with another cover plate that is integrated with a rechargeable power supply.

FIG. 1 is an illustration of a modified back plate cover 160 for an electric guitar, according to embodiments of the invention. An electric guitar 150 may include a pickup 152 for detecting vibrations from the electric guitar's strings 154 and outputting a signal to, for example, a speaker or other audio device. On the back 156 of the electric guitar 150, a control cavity 155 may be recessed within the body 158 of the electric guitar 150. Electronic controls and connections may be placed within the control cavity 155, for example, to allow a musician to control or alter the pickup's 152 frequency response characteristic (e.g., and providing the guitar's unique sound). A modified back plate cover 160 may cover the control cavity 155. The modified back plate 160 may include, for example, screw holes 162 that align with the guitar's screw holes (not shown) so that it can replace the guitar's original back plate (e.g., the back plate that was originally manufactured with the guitar). As shown, the external surface 164 of the back plate 160 (e.g., the surface of the back plate that faces the external or outside environment of the guitar 150) may include a receptacle 168 that passes through the back plate 150. The receptacle 168 may be accessible through the back plate to connect power to a rechargeable battery contained or integrated behind the back plate and within the control cavity 155. The rechargeable battery may alternatively be other kinds of rechargeable power sources, such as super capacitors.

Figure 2:
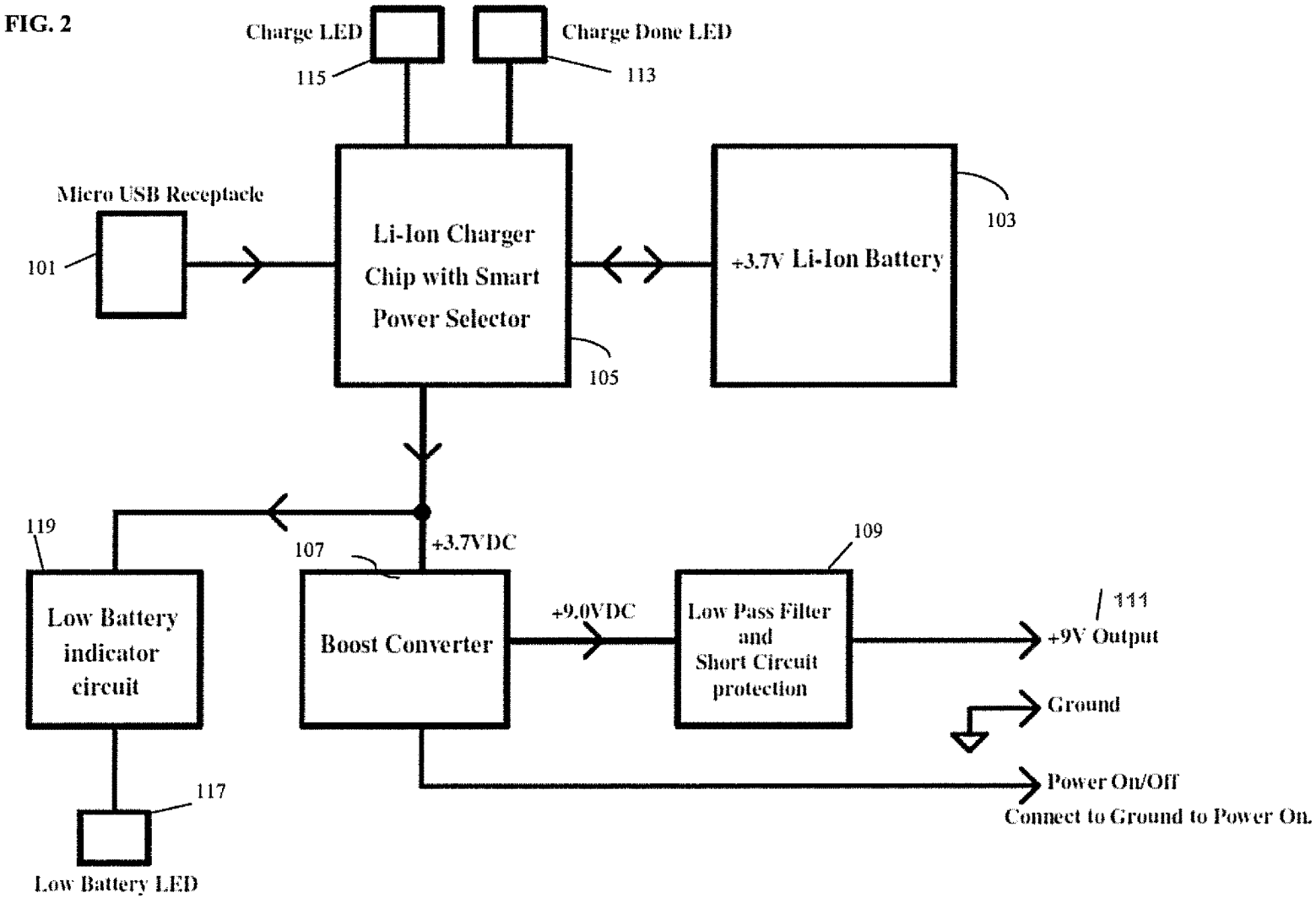
FIG. 2 is block diagram of a rechargeable power source for an electric guitar, according to embodiments of the invention.

FIG. 2 is a block diagram of a rechargeable power circuit for an electric guitar, according to embodiments of the invention. A micro USB receptacle 101 or other kind of plug or receptacle (e.g., standard USB) may allow the input of power to charge a rechargeable battery 103. When charging, the receptacle 101 may be directly connected to a power source, such as a computer or outlet. A charging circuit or chip 105 may control the input and output of current from the rechargeable battery 103. The rechargeable battery 103 may be composed of any chemicals known in the art used for electrochemical cells, such as lead acid, nickel cadmium, nickel metal hydride, lithium ion, or lithium ion polymer. When the electric guitar or instrument is being played, or when the battery 103 is no longer being charged, the battery may provide power to the guitar or components of the guitar such as active pickups or a Tip/Ring/Sleeve (TRS) circuit via the charging circuit 105, boost converter 107, low pass filter 109, and output 111 to guitar components such as the electric guitar's pickup. The boost converter 107 may provide a boost to the voltage output from the battery in order to maintain a high level of voltage powering the guitar's pickup. A high level of voltage may be desired to maintain volume or distortion effects. A typical electric guitar may require 9-20 volts for peak performance. The boost converter 107 may provide musicians a selectable range of power, for example Light emitting diodes (LED's) may be used as indicators to signify to a user the level of charge left in the rechargeable battery 103. For example, LED 113 may indicate that the rechargeable battery 103 has completed charging, LED 115 may indicate that the rechargeable battery is currently charging ad LED 117 may indicate that the charge or power level in the rechargeable battery is low due to, for example, an extended amount of playing time. The low battery LED indicator 117 may be responsive to or coupled with a low battery indicator circuit 119, for example.

Figure 3:
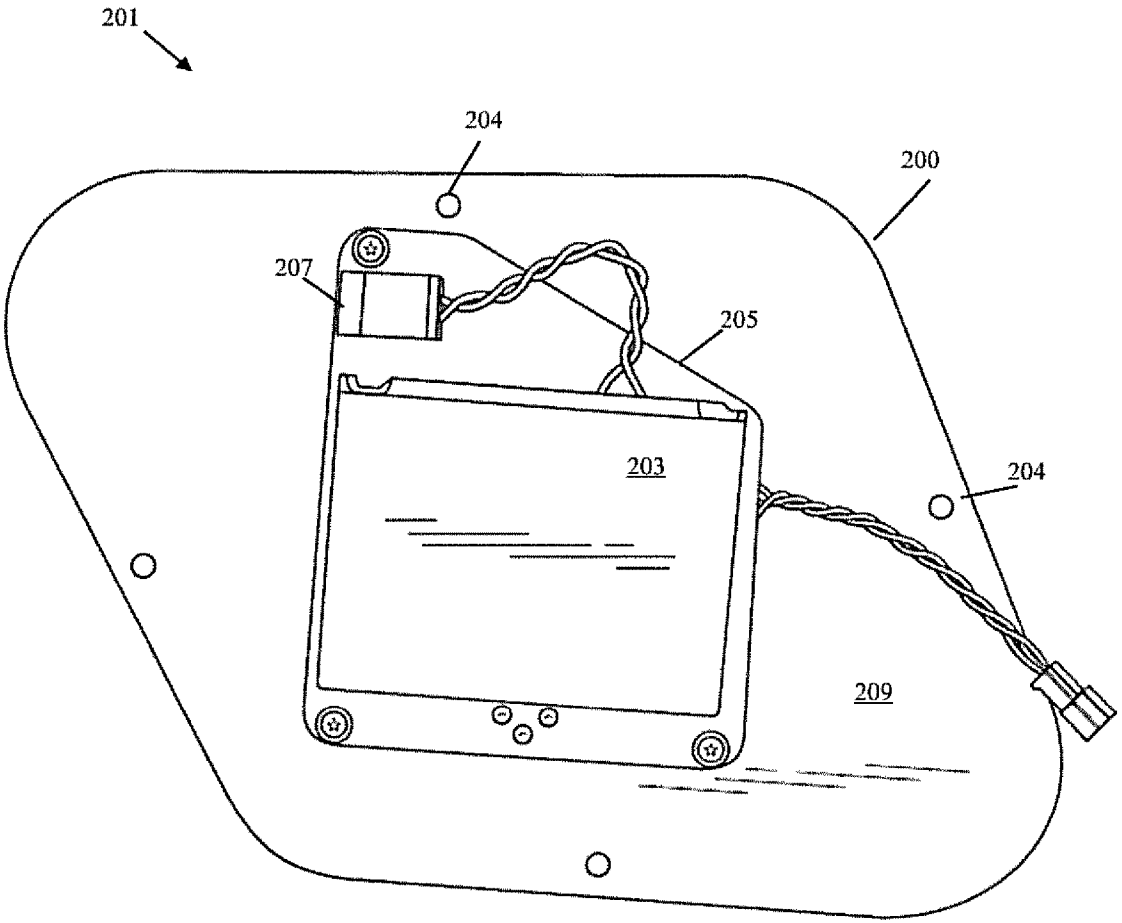
FIG. 3 is an illustration of a rechargeable power pack, according to embodiments of the invention.

FIG. 3 is an illustration of a rechargeable battery pack 201, according to embodiments of the invention. The battery pack may be contained behind a back plate 200, within or substantially within the external shell, shape, or body of the guitar. The battery pack may, for example, fit on a Gibson® Les Paul guitar. The battery pack may include a rechargeable battery 203 and be integrated or adhered to a printed circuit 205 that includes a smart charging circuit 207 or other circuitry, for example. Other circuitry may include a low pass filter in order to mitigate against or remove switching noise from the boost converter's DC (direct current) output voltage. The rechargeable battery may be disposed flat or parallel to the back plate 200 on its internal surface 209 (e.g., the surface of the back plate that faces the control cavity). The back plate 200 may have the same shape as a removable back plate that was originally installed with the guitar 202 (e.g., when the guitar was first manufactured). The back plate 200 may have the same alignment of screw holes 204 as the originally installed back plate.

Figure 4:
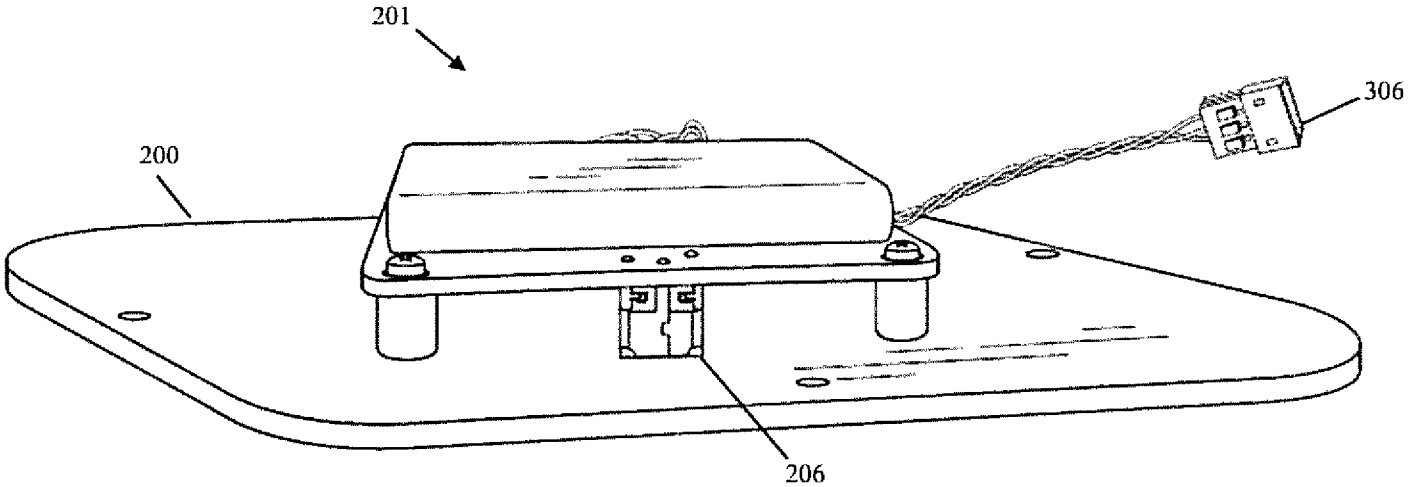
FIG. 4 is an illustration of a side view of a rechargeable power pack, according to embodiments of the invention.

FIG. 4 is an illustration of a side view of a rechargeable battery pack 201, according to embodiments of the invention. The back plate 200 may include an access point for a receptacle 206 (e.g., a micro USB receptacle) to charge the battery. A receptacle, such as a USB or micro USB receptacle, may allow input of power to the rechargeable battery 300. The battery's output connector 306 may be connected to the electric guitar's components such as the pickup and may replace the guitar's original power source connection. As shown, the rechargeable battery 201 may be disposed or installed on the interior surface of back plate 200. The rechargeable battery 203 may be adhered to the back plate 200 via integration with a circuit board, for example. While the rechargeable battery 201 may extend somewhat from the internal surface of the back plate, the battery pack 201 may still fit completely within the guitar's control cavity.

Figure 5A:
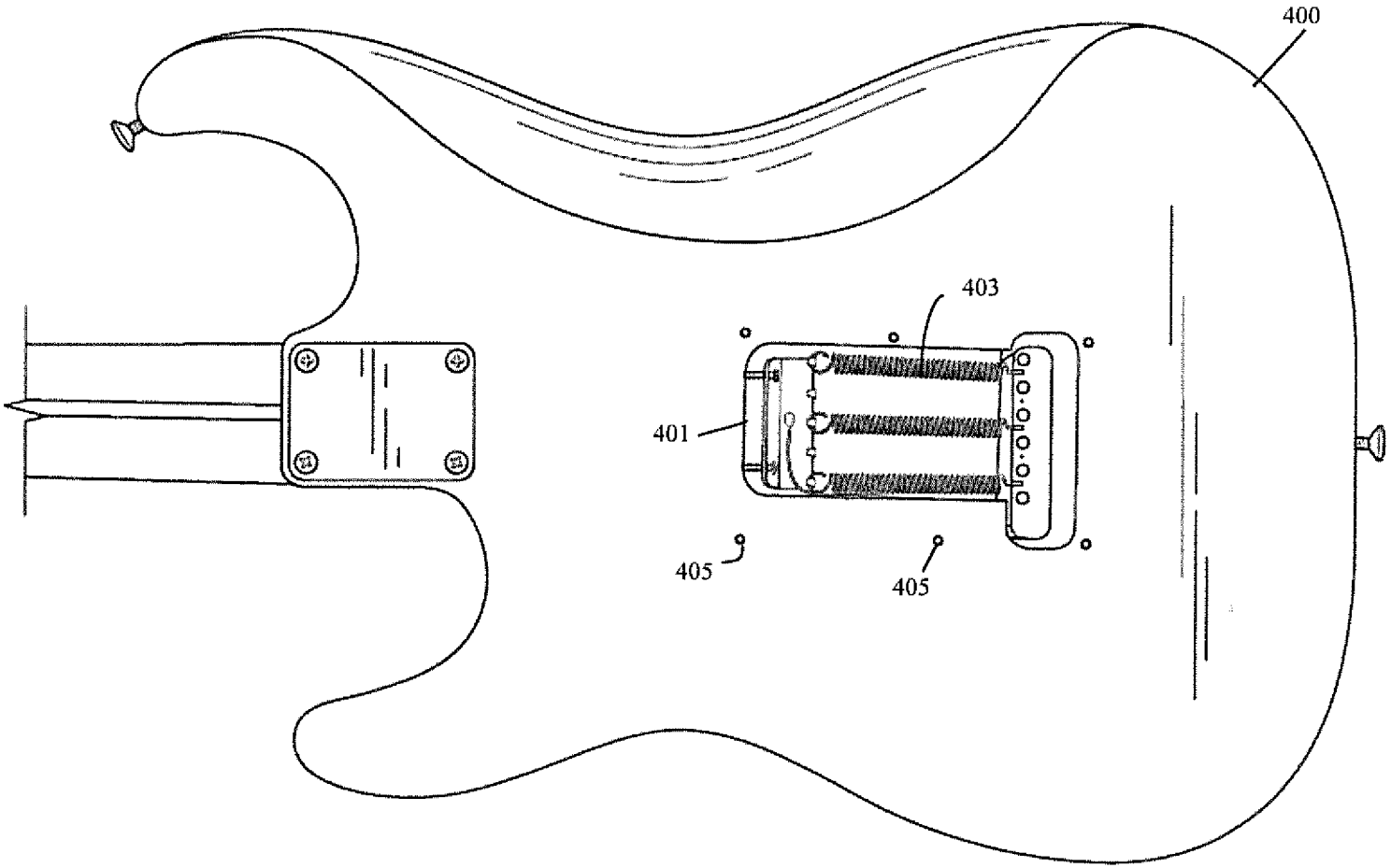
FIG. 5A is an illustration of a spring cavity for a Fender Stratocaster electric guitar 400, according to embodiments of the invention.
Figure 5B:
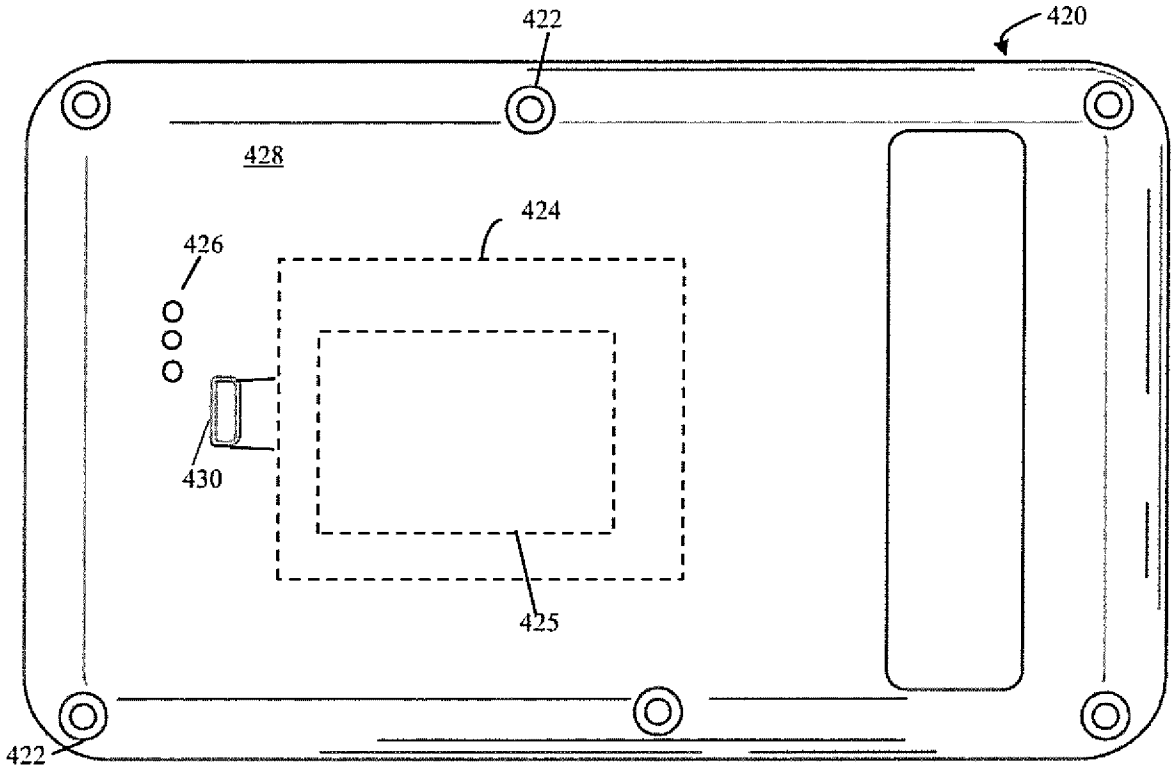
FIG. 5B is an illustration of a back cover or back plate for a Fender Stratocaster, according to embodiments of the invention.

FIG. 5A is an illustration of a standard cavity for a Fender Stratocaster electric guitar 400, according to embodiments of the invention. As shown, the standard cavity 401 may include springs 403 and other electronics, and the guitar may include screw holes 405 to use for attaching a cover plate. FIG. 5B is an illustration of a back cover 420 or cover plate for a Fender Stratocaster, according to embodiments of the invention. As shown, the back cover 420 may include screw holes 422 that align with the screw holes of the guitar 400 (see screw holes 405 in FIG. 5A). The back cover 420 can fit a Fender Stratocaster through similarly aligned screws and can include a rechargeable battery pack 424 (shown as on the underside, with a power source 425 also integrated), and thus the back cover 420 and power pack 424 can replace the guitar's 400 original or standard cover plate. The power pack 424 may not significantly change the guitar's body's characteristics and may maintain nearly the same feel as a regular electric guitar. LED indicators 426 may be visible on the external surface 428 of the back cover 420. A receptacle 430 accessible through the back cover 420 to connect power to the rechargeable battery pack 424. Due to the springs 403 which may crowd the standard cavity 401 in the Fender Stratocaster guitar 400, the back cover 420 may be molded or manufactured to extend slightly beyond the body of guitar 400. However, the rechargeable battery and cover plate may together extend less than a half inch beyond the electric guitar's body (e.g., protrude less than a half inch from the guitar's body towards the guitar's external environment). The rechargeable battery further may not extend beyond the back cover (e.g., the rechargeable battery is disposed on an internal surface of the back cover). Other configurations may be possible.

Figure 6A:
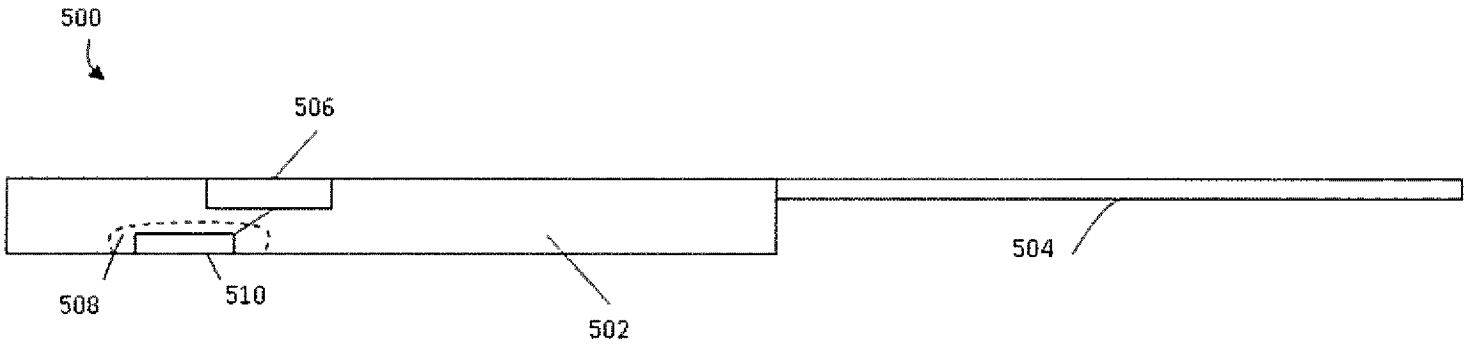
FIGS. 6A and 6B are diagrams of a retrofittable battery or power pack within an electric guitar, according to embodiments of the invention.
Figure 6B:
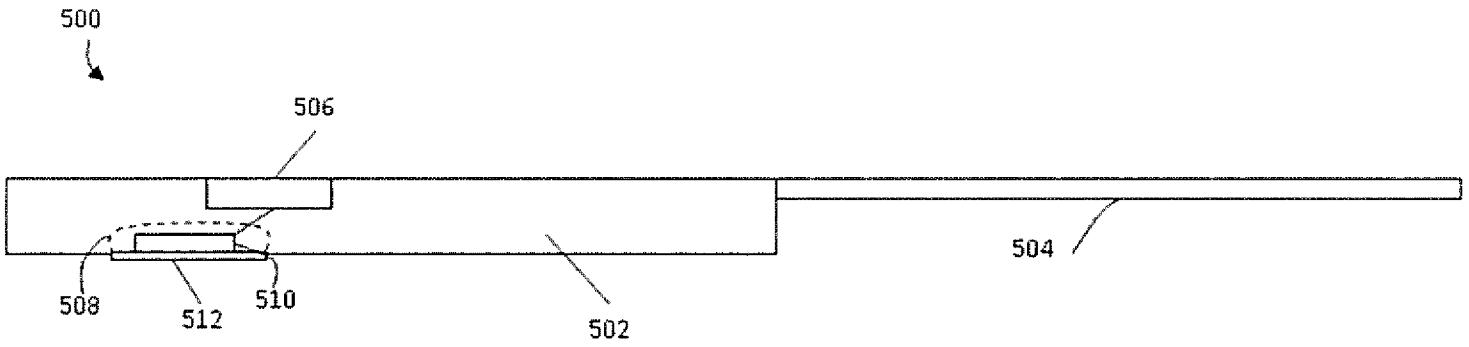

FIGS. 6A and 6B are diagrams of a retrofittable battery or power pack within an electric guitar, according to embodiments of the invention. An electric guitar 500 may include an electric guitar body 502 and neck 504. Strings may be attached along the body 502 and neck 504, with an electric pickup 506 or other device to detect the strings' vibrations when played by a musician. The pickup 506 may be placed within the electric guitar body 502. There may be other electronics connected to the pickup, such as volume or other controls, accessed from a standard back plate. There may be a standard cavity or recess 508 on the back of the electric guitar body 502 and extending within the guitar. A rechargeable battery 510 may be placed within the recess 508 and attached to a cover plate. The battery 510 may be contained entirely within the recess and not extending beyond the back plate of the guitar. The rechargeable battery 510 may connect and provide power to the pickup 506, for example. In FIG. 6B, a cover plate 512 may be integrated or adhered with rechargeable battery 510 that is within a standard cavity. Cover plate 512 may cover, for example, a standard control cavity or a spring cavity that includes springs (e.g., springs 403 in FIG. 5A) to counterbalance the guitar string's tension. For a spring cavity, (e.g., cavity 401 in FIG. 5A), the cover plate may extend slightly beyond the guitar's external surface in order to ensure that the rechargeable power system does not interfere with the springs in the spring cavity. The cover plate may be manufactured so as not to extend more than a half inch beyond the external surface of the electric guitar's body. Other dimensions may be used for cover plates.

Embodiments of the invention have been described with respect to what is presently believed to be the best mode with the understanding that these embodiments are capable of being modified and altered without departing from the teaching herein. Therefore, the invention should not be limited to the precise details set forth herein but should encompass the subject matter of the claims that follow and the equivalents of such modifications and changes as fall within the true spirit of the invention.

What is claimed is:

1. An electric guitar, comprising:

a first side having mounted thereon guitar strings;

a second side opposite the first side comprising a standard spring cavity, the standard spring cavity comprising springs to counterbalance the tension of the guitar strings, the standard spring cavity being created at the time of the manufacture of the guitar, the standard spring cavity having the design of the standard spring cavity of a Fender STRATOCASTER® guitar;

a pickup to detect vibrations from the electric guitar's strings and output a signal;

a back plate to cover the standard spring cavity, the back plate being the same size and shape as the cover originally manufactured to cover the standard spring cavity;

a rechargeable power source to provide power to the pickup;

the rechargeable power source disposed flat and parallel to the back plate;

a charging circuit to control the input and output of current to and from the rechargeable power source; and a jack for connection to a charger.

2. The electric guitar of claim 1, wherein the rechargeable power source is disposed on an inner surface of the back plate.

3. The electric guitar of claim 1, wherein the back plate and the rechargeable power source are to replace an original back plate of the electric guitar.

4. The electric guitar of claim 1, wherein the back plate includes screw holes aligned with screw holes on the electric guitar.

5. The electric guitar of claim 1, comprising a micro USB (Universal Serial Bus) receptacle accessible through the back plate to connect power to the rechargeable power source.

6. The electric guitar of claim 1, comprising a light-emitting diode visible on the external surface of the back plate to indicate that the rechargeable power source is charging.

7. An electric guitar, comprising:

a first side having mounted thereon guitar strings;

a standard control cavity on the second side, the standard control cavity being created at the time of the manufacture of the guitar, the standard control cavity having the design of the standard control cavity of a Gibson LES PAUL guitar;

a pickup to detect vibrations from the electric guitar's strings and output a signal;

a back plate to cover the standard control cavity, the back plate being the same size and shape as the cover originally manufactured to cover the standard control cavity;

a rechargeable power source adhered to the back plate, and extending from the back plate into the control cavity and extending slightly and less than half an inch from the back plate beyond the shape of the guitar to provide power to the pickup;

a charging circuit to control the input and output of current to and from the rechargeable power source;

the rechargeable power source and charging circuit contained within the standard control cavity; and a jack for connection to a charger.

8. The electric guitar of claim 7, wherein the rechargeable power source is disposed on an inner surface of the back plate.

9. The electric guitar of claim 7, wherein the back plate includes screw holes aligned with screw holes on the electric guitar.

10. The electric guitar of claim 7, comprising a micro USB (Universal Serial Bus) receptacle accessible through the back plate to connect power to the rechargeable power source.

11. The electric guitar of claim 7, comprising a light-emitting diode visible on the external surface of the back plate to indicate that the rechargeable power source is charging.

12. The electric guitar of claim 7, wherein the back plate and the rechargeable power source are to replace an original back plate of the electric guitar.

13. An electric guitar, comprising:

a first side having mounted thereon guitar strings;

a standard control cavity on the second side, the standard control cavity being created at the time of the manufacture of the guitar, the standard control cavity having the design of the standard control cavity of a Gibson LES PAUL guitar;

a pickup to detect vibrations from the electric guitar's strings and output a signal;

a back plate to cover the standard control cavity, the back plate being the same size and shape as the cover originally manufactured to cover the standard control cavity;

a rechargeable power source adhered to the back plate, and extending from the back plate into the control cavity to provide power to the pickup;

a charging circuit to control the input and output of current to and from the rechargeable power source;

the rechargeable power source and charging circuit contained within the standard control cavity; and a jack for connection to a charger.

14. The electric guitar of claim 13, wherein the back plate includes screw holes aligned with screw holes on the electric guitar.

15. The electric guitar of claim 13, comprising a micro USB (Universal Serial Bus) receptacle accessible through the back plate to connect power to the rechargeable power source.

16. The electric guitar of claim 13, comprising a light-emitting diode visible on the external surface of the back plate to indicate that the rechargeable power source is charging.

17. The electric guitar of claim 13, wherein the back plate and the rechargeable power source are to replace an original back plate of the electric guitar.

18. An electric guitar comprising:

a first side having mounted thereon guitar strings;

a standard pre-existing control cavity disposed on the second side, the standard control cavity being created at the time of the manufacture of the guitar;

a pickup to detect vibrations from the electric guitar's strings and output a signal;

a back plate to cover the standard control cavity, the back plate being the same size and shape, and having same screw alignment, as the cover originally manufactured to cover the standard control cavity;

a rechargeable power source and a circuit board contained within the standard control cavity to provide power to the pickup;

a charging circuit to control the input and output of current to and from the rechargeable power source;

the rechargeable power source, circuit board, and charging circuit contained entirely within the standard control cavity, and not requiring modification to the guitar's body structure when the back plate is fastened to the guitar; and a jack for connection to a charger, the jack being in a receptacle passing through the back plate.

19. The electric guitar of claim 18, wherein the rechargeable power source is disposed on an inner surface of the back plate.

* * * * *